US006149046A

United States Patent [19]

Ho et al.

[11] Patent Number: 6,149,046

[45] Date of Patent: Nov. 21, 2000

[54] SAFETY DEVICE FOR PREVENTING EJECTING MECHANISM FROM HITTING PUSHING MEMBER IN A MAGAZINE OF A POWER STAPLER

[75] Inventors: Roman Ho; Jack Chen; Hsuam-Chi Chiang, all of Taichung, Taiwan

[73] Assignee: Basso Industry Corp., Taichung, Taiwan

[21] Appl. No.: 09/431,136

[22] Filed: Nov. 1, 1999

[51] Int. Cl.[7] ..... B25C 1/04

[52] U.S. Cl. ..... 227/8; 227/120

[58] Field of Search ..... 227/8, 120, 142, 227/135, 136

[56] References Cited

U.S. PATENT DOCUMENTS

| | | | |
|---|---|---|---|
| 4,597,517 | 7/1986 | Wagdy | 227/8 |
| 4,688,710 | 8/1987 | Massari, Jr. et al. | 227/8 |
| 4,903,880 | 2/1990 | Austin et al. | 227/120 |
| 5,180,091 | 1/1993 | Ota | 227/120 |
| 5,803,338 | 9/1998 | Singer et al. | 227/120 |
| 5,816,468 | 10/1998 | Yang | 227/8 |

*Primary Examiner*—Scott A. Smith
*Attorney, Agent, or Firm*—Charles E. Baxley

[57] ABSTRACT

A safety device for a power stapler includes a pushing member movably received in a magazine of a power stapler. The pushing member has a protrusion extending from a top thereof and a block is fixedly connected to a side of the protrusion. A sliding member is slidably connected to the barrel of the power stapler and a recess defined in an end of the sliding member. When the last staple runs out, the block on the pushing member is engaged with the recess of the sliding member to stop the movement of the sliding member and the ejecting mechanism.

2 Claims, 4 Drawing Sheets

SAFETY DEVICE FOR PREVENTING EJECTING MECHANISM FROM HITTING PUSHING MEMBER IN A MAGAZINE OF A POWER STAPLER

FIELD OF THE INVENTION

The present invention relates to a safety device for a power stapler, and more particularly, to a safety device connected to the pushing member to be inserted into a recess of the sliding member to prevent the sliding member from pushing backward so as to stop the ejecting mechanism hitting the pushing member when the last stapler is used.

BACKGROUND OF THE INVENTION

A conventional power stapler is shown in FIG. 1 and includes a barrel 100 and a magazine 13 is connected to the barrel 100. A pushing member 11 is movably received in the magazine 13 by a spring means 12 so that the staplers 10 in the magazine 13 is pushed toward the barrel 100. In other words, the staplers 10 will be automatically fed to the barrel 100 one by one. A sliding member 101 is slidably mounted to the barrel 100 and actuates the ejecting mechanism of the power stapler to ready for next shoot. Therefore, the sliding member 101 will slide reciprocatingly along the barrel 100 if the user pulls the trigger continuously, and the upper-most stapler 10 in the magazine will be ejected by the ejecting member of the ejecting mechanism. The pushing member 11 has two protrusions 14 to catch the staplers 10 in the magazine 13. Nevertheless, when the last stapler is used out, the protrusions 14 will located in the barrel 100 and the ejecting mechanism still moves to hit the protrusion 14. This will damages the important mechanism of the power stapler.

The present invention intends to provide a safety device that prevent the pushing mechanism from moving when the last stapler runs out. The safety device in accordance with the present invention effectively resolves the inherent shortcoming of the conventional power stapler as described above.

SUMMARY OF THE INVENTION

In accordance with one aspect of the present invention, there is provided a safety device for a power stapler which has a magazine connected to a barrel, and the safety device comprises a sliding member slidably connected to the barrel and has a recess defined in one of two ends thereof. A pushing member is biasedly received in the magazine and has a protrusion extending from an end of the pushing member. A block is connected a side of the protrusion so that when the last staple runs out, the protrusion of the pushing member is engaged with the recess of the sliding member to stop the movement of the sliding member.

The primary object of the present invention is to provide a safety device which stops the movement of the sliding member when the last staple is used.

Another object of the present invention is to provide a safety device for preventing the ejecting mechanism from hitting the pushing member when the last staple runs out.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
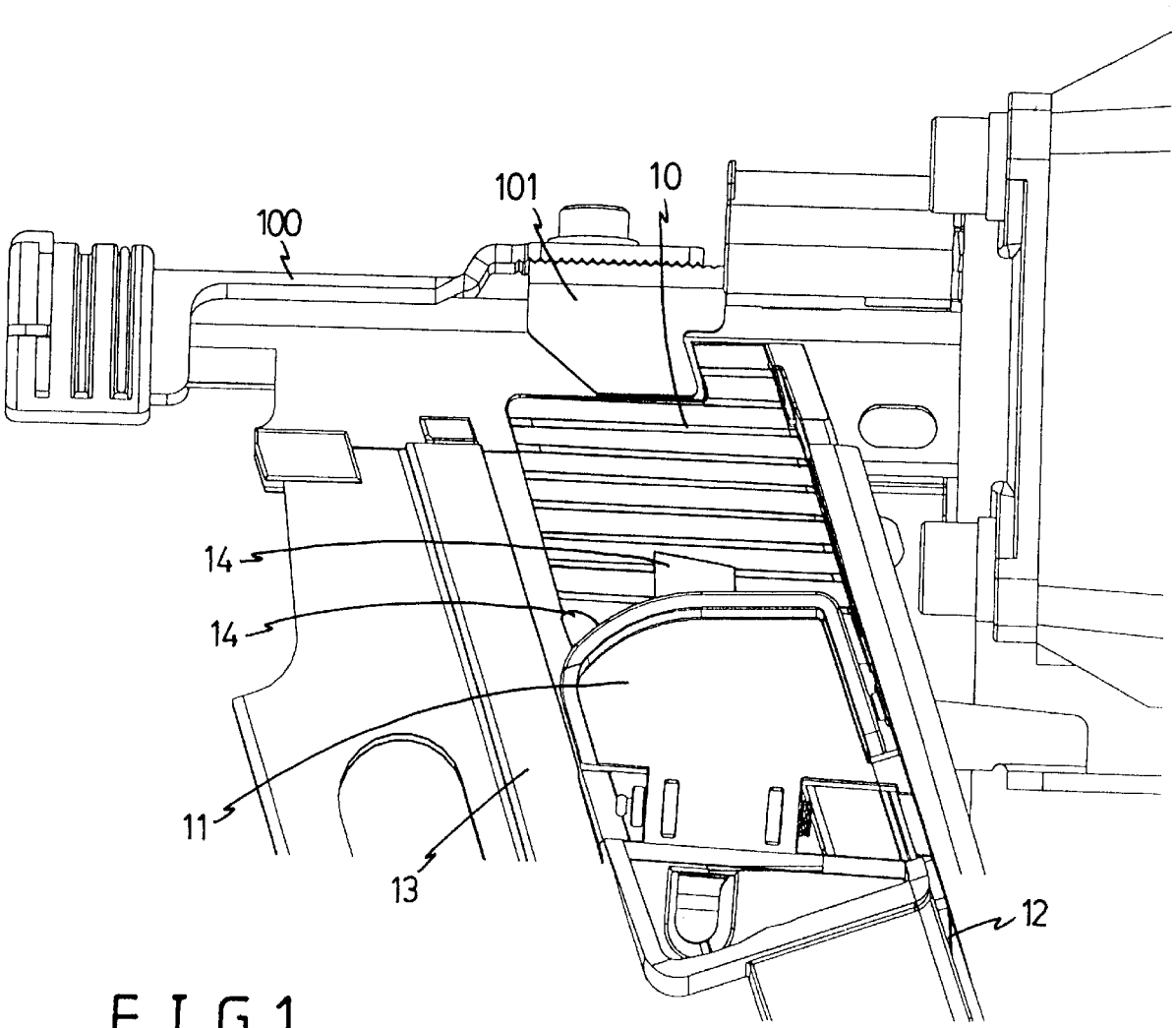
FIG. 1 PRIOR ART
FIG. 1 is a side view to show a conventional pushing member in a magazine of a power stapler.
Figure 2:
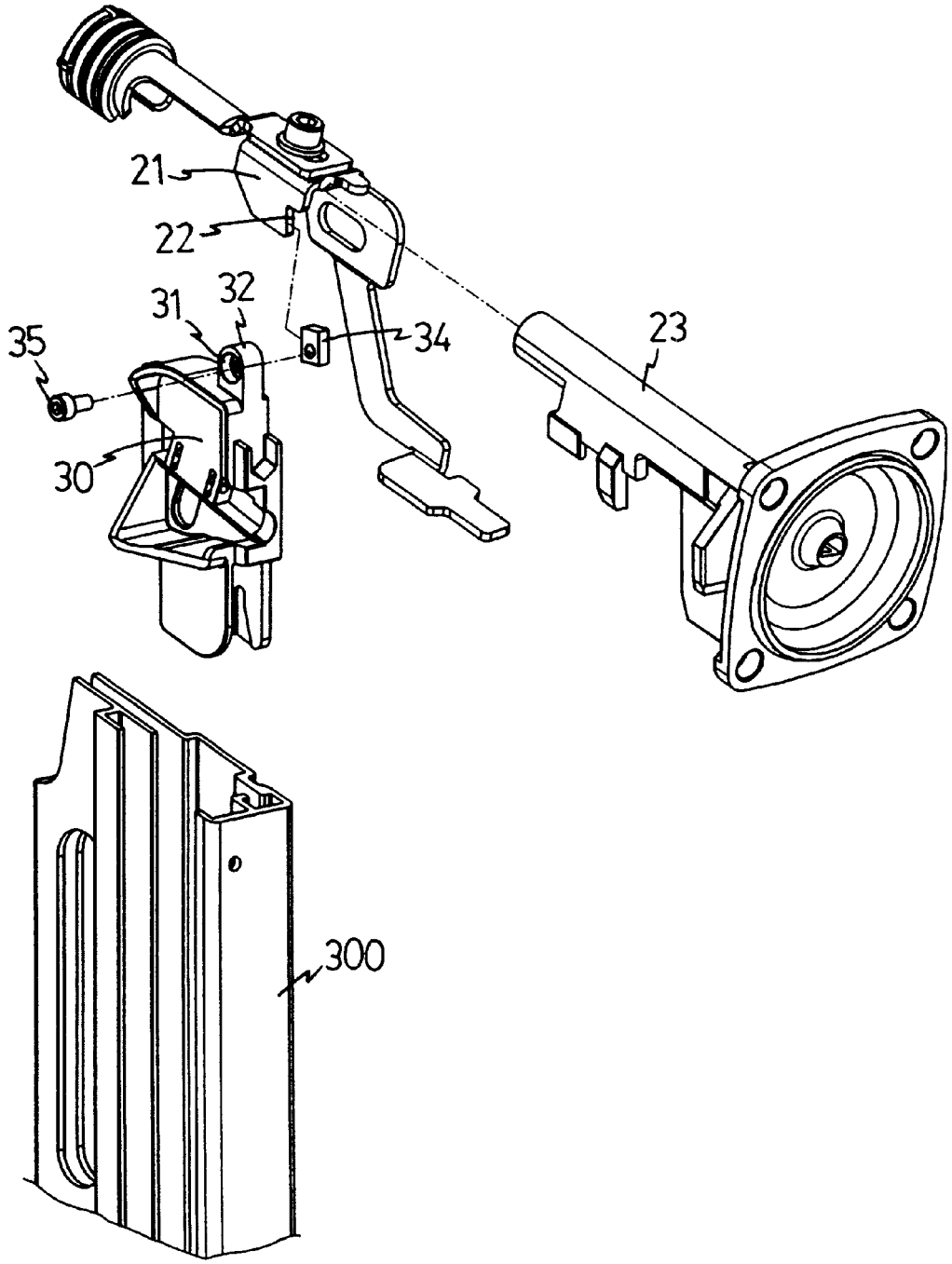
FIG. 2 is an exploded view of the safety device for a power stapler in accordance with the present invention.
Figure 3:
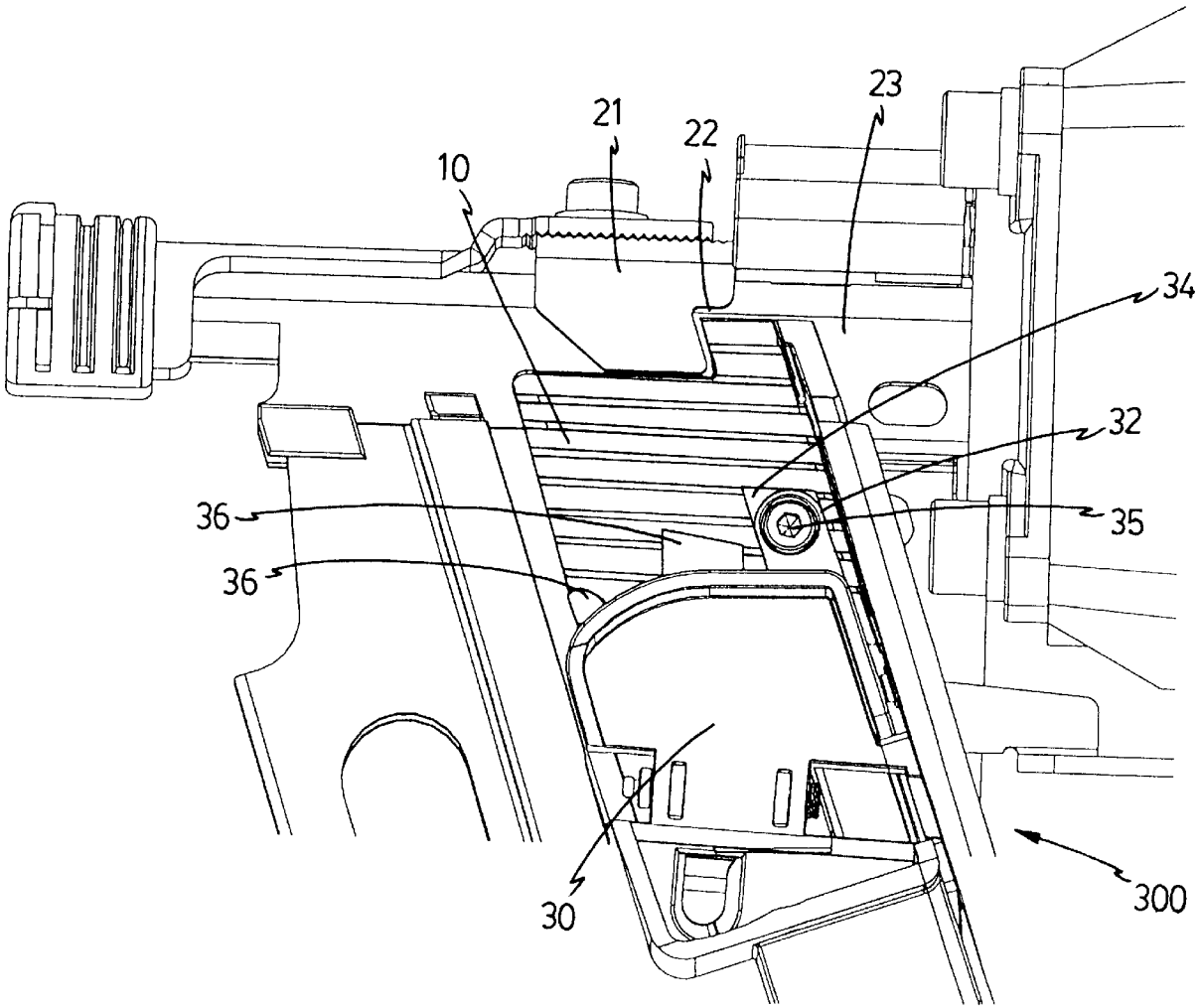
FIG. 3 is a side view to show the pushing member of the present invention pushing the staplers in a magazine.

Referring to FIGS. 2 and 3, a power stapler includes a barrel 23, a magazine 300 removably connected to the barrel 23, and a sliding member 21 slidably connected to the barrel 23. The sliding member 21 has a recess 22 defined in one of two ends thereof A pushing member 30 is movably received in the magazine 30 and biased by a spring member so as to push a stack of staples 10 in the magazine toward the barrel 23. The upper-most staple 10 of the stack of staples 10 will be automatically fed into the barrel 23. When the user pulls the trigger, the pneumatic power connected to the power stapler powerfully push the ejecting mechanism to eject the upper-most staple out from the barrel 23. The sliding member 21 then reciprocatingly moves along the barrel 23 to let the ejecting mechanism return to its original position ready for next shoot.

The sliding member 30 has a protrusion 32 extending from an end of the pushing member 30 and the protrusion 30 has a threaded hole 31 defined therethrough. A block is connected to the protrusion 32 by engaging a bolt 35 with the threaded hole 31 and engaged with the block 34. Two catchers 36 on the pushing member 30 are used to retain the stack of staplers 10 in position.

Figure 4:
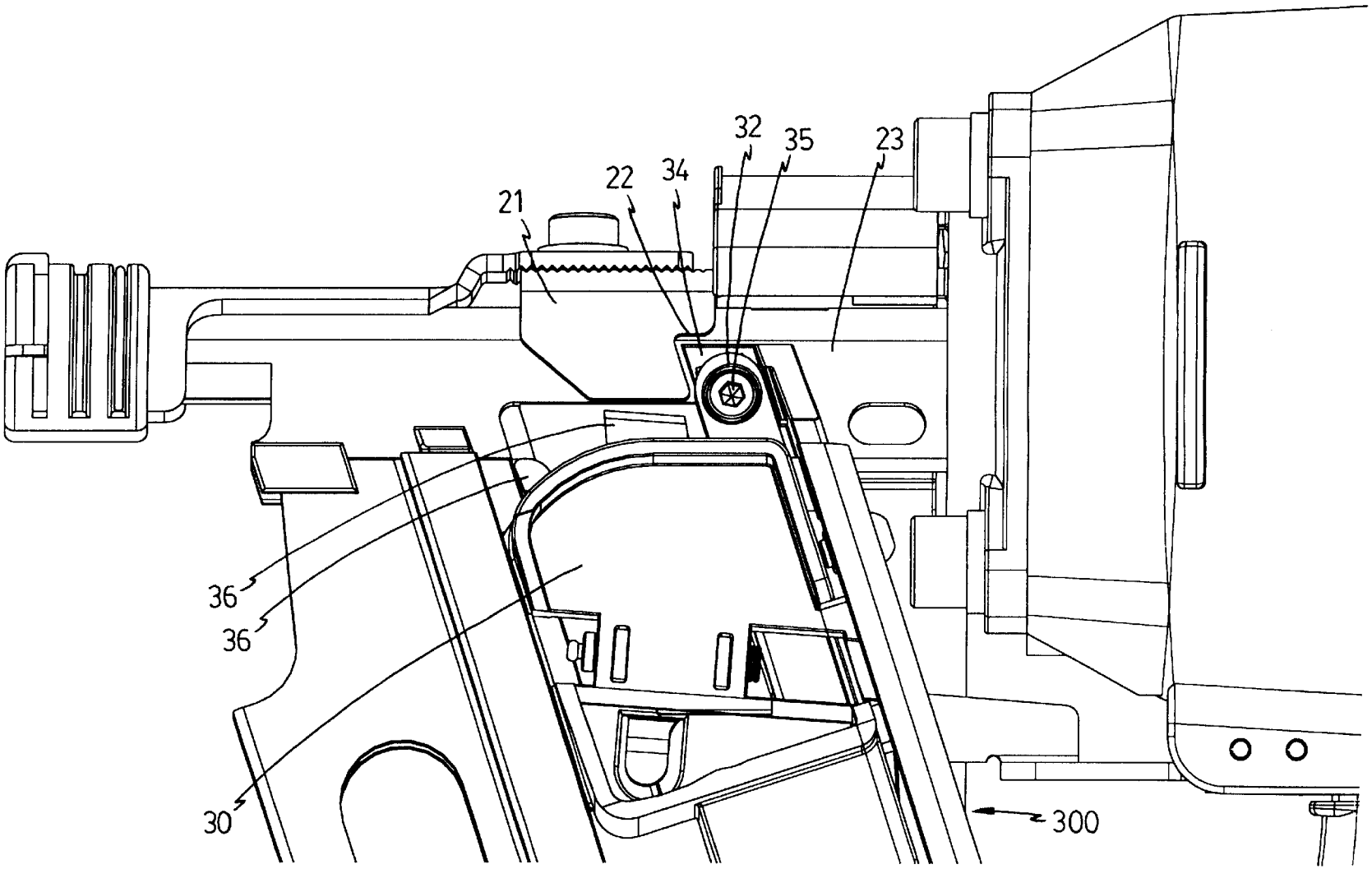
FIG. 4 is a side view to show when last staple in the magazine runs out, the protrusion of the pushing member of the present invention is engaged with the recess of the sliding member.

Referring to FIG. 4, when the last staple 10 runs out, the pushing member 30 is located near the barrel 23. At the position, the block 34 is inserted in the barrel 23 and it is sized to be received in the recess 22 of the sliding member 21. The sliding member 21 cannot move because of the engagement of the block 34 in the recess 22.

Therefore, when the last staple 10 is ejected, the ejecting mechanism is stopped so that the ejecting mechanism will not hit the pushing member 30 as happened in the conventional power stapler. It is not necessary for the user to count the numbers of staples 10 left in the magazine, when the last staple 10 is ejected, the ejecting mechanism is automatically stopped.

While we have shown and described various embodiments in accordance with the present invention, it should be clear to those skilled in the art that further embodiments may be made without departing from the scope and spirit of the present invention.

What is claimed is:

1. A safety device for a power stapler which has a magazine connected to a barrel of the power stapler, said safety device comprising:

a sliding member adapted to be slidably connected to the barrel and having a recess defined in one of two ends thereof;

a pushing member adapted to be biasedly received in the magazine and having a protrusion extending from an end of said pushing member, and a block connected a side of said protrusion.

2. The safety device as claimed in claim 1, wherein said protrusion has a threaded hole defined therethrough and said block is connected to said protrusion by engaging a bolt with said threaded hole and engaged with said block, said block sized to be received in said recess of said sliding member.

* * * * *